United States Patent [19]

Mechachonis

[11] 3,991,686

[45] Nov. 16, 1976

[54] KNOCKDOWN DISPLAY STAND

[76] Inventor: James I. Mechachonis, 1100 Poquonock Ave., Windsor, Conn. 06095

[22] Filed: July 29, 1975

[21] Appl. No.: 599,957

[52] U.S. Cl. ..... 108/28; 108/103; 108/111

[51] Int. Cl.[2] ..... A47B 41/04

[58] Field of Search ..... 248/157, 188.7, 188.2; 108/28, 111, 103, 128, 139, 29, 153; 211/177, 148

[56] References Cited

UNITED STATES PATENTS

| | | | |
|---|---|---|---|
| 344,771 | 6/1886 | Cushing | 108/28 |
| 1,936,428 | 11/1933 | Friesner | 108/28 |
| 3,021,960 | 2/1962 | Pipe | 248/188.7 X |
| 3,186,560 | 1/1965 | De Cristino | 211/177 |
| 3,827,571 | 8/1974 | Koutny | 211/177 X |
| 3,841,631 | 10/1974 | Dolan | 248/159 |

FOREIGN PATENTS OR APPLICATIONS

| | | | |
|---|---|---|---|
| 211,013 | 9/1960 | Austria | 108/28 |
| 906,725 | 9/1962 | United Kingdom | 211/177 |

*Primary Examiner*—James T. McCall
*Attorney, Agent, or Firm*—McCormick, Paulding & Huber

[57] ABSTRACT

A display stand includes a central post supporting a number of vertically spaced brackets having arms extending outwardly from the post for supporting displayed articles, such as potted plants suspended therefrom. A revolvable table surrounds the post below the brackets and may be used to support additional articles for display or for other purposes. The stand is comprised of a number of parts joined to one another by slip fit joints enabling the parts to be readily assembled and disassembled and to be packaged in a relatively small space for storage or shipment.

3 Claims, 6 Drawing Figures

KNOCKDOWN DISPLAY STAND

BACKGROUND OF THE INVENTION

This invention relates to a stand for supporting articles for display, and deals more particularly with such a stand which is of a knockdown construction, that is, made up of a number of parts readily and easily assembled and disassembled to set up or take down the stand.

The stand of this invention is particularly well-adapted for use in displaying potted plants which are suspended from the ends of brackets included in the stand. However, it is not necessarily limited to this use and may instead be used for displaying various other types of articles, if desired. Also, the stand may for instance serve as a decorative item in a home or office or as a device in a store or for attractively presenting the displayed articles for sale to potential customers. The stand also includes a revolvable table which may be put to various different uses, depending on where the stand is placed and other factors.

One common problem with display stands is that they are usually of a relatively large size making them difficult to ship from place to place and to store when not in use.

The general object of this invention is therefore to make a display stand which is attractive and functional for displaying potted plants or other articles. A further object is to provide such a stand which is made of a number of parts which are readily assembled and disassembled, and which allow the stand when disassembled to be packaged in a small container for storage or shipment.

Another object of the invention is to provide a display stand of the foregoing character in which the height and number of display brackets of the stand may be varied to suit the desires of the user simply adding or subtracting standardized parts to or from the stand.

A still further object of the invention is to provide a display stand wherein the display brackets, from which plants or other displayed articles are hung, may be angularly shifted by hand relative to the post to vary the exposure of the plants to the sun or to otherwise vary the display as seen from a given position.

Another object of the invention is to provide a plant stand of the aforegoing character, which, except for the table top may be conveniently fabricated from metal parts of standard rod, bar and tubular shapes.

Other objects of the invention will be apparent from the foregoing description and from the drawings forming a part hereof.

SUMMARY OF THE INVENTION

The invention resides in a display stand, for potted plants or other articles, consisting of a base, a post extending upwardly from the base and a plurality of vertically spaced brackets carried by the post. The post is made of a plurality of sections arranged end-to-end and connected to one another by slip fit telescopic joints each provided by a socket part attached to one end of one of the post sections and slidably receiving the adjacent end of the adjacent post section. Each bracket is attached to an associated post section by having the section pass loosely vertically through it, and it is vertically supported by resting on the socket part of the joint immediately beneath it. The post sections may therefore be slipped from one another for disassembly, and the brackets may be slipped off of their associated post sections for further disassembly.

The invention also resides in the display stand including a revolvable table top provided by a table support having a tubular part loosely received on the lowermost post section and having a plurality of upwardly and outwardly extending arms for revolvably supporting a horizontal table top having a central opening through which the post extends. Also, the base is a part similar to the table support and consists of a tubular central part which slidably receives the lower end of the lower post section and a number of downwardly and outwardly extending legs fixed to the center part.

DETAILED DESCRIPTION OF THE PREFERRED EMBODIMENT

Figure 1:
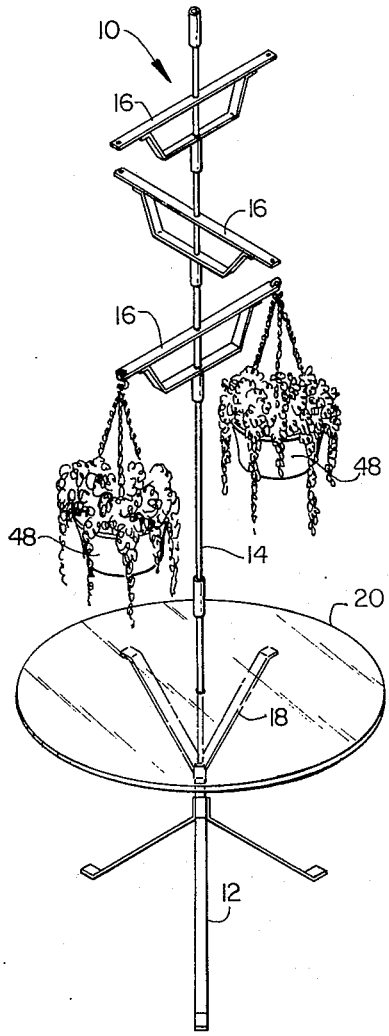
FIG. 1 is a perspective view of a plant stand embodying this invention.

Turning to the drawings, the plant stand there shown is indicated generally at 10 and includes a base 12, a vertical post 14 and a number of brackets 16, 16 carried by the post 14 and spaced vertically along its length. It also includes a table support 18 and a round horizontal table top 20. Although not necessarily so, the table top 20 is preferably made of glass or transparent plastic and the remainder of the parts of the stand are made of iron or other metal.

The illustrated base 12 is made up of a central tubular part 22 and three legs 24, 24 which are welded to the part 22 and which extend downwardly and outwardly therefrom. The table support 18, except for being inverted, is of a construction similar to that of the base 12. It includes a central tubular part 26, which rests for vertical support on the part 22 of the base, and three arms 28, 28 welded to the part 26 and extending upwardly and outwardly therefrom, as shown, with the upper ends thereof vertically supporting the table top 20 which rests loosely thereon.

Figure 6:
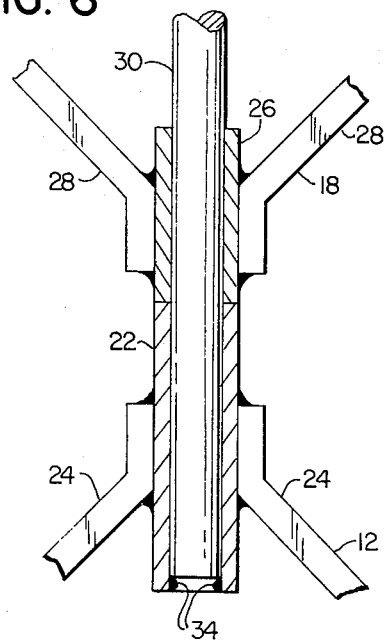
FIG. 6 is a view partly in vertical section and partly in elevation, taken on the line 6—6 of FIG. 2, showing the joint between the base, the table support and the lowermost post section of the plant stand of FIG. 1.

The post 14 is comprised of a number of individual sections arranged end-to-end. In particular, these post sections consist of two long sections 30, 30, of equal length, comprising the lower portion of the post, and three short sections 32, 32, of equal length, comprising the upper portion of the post. Each post section is made of a cylindrical rod, and, as shown best in FIG. 6, the lowermost section 30, at its lower end fits loosely through the central tubular part 22 of the base. At its lower end the base part 22 is at least partially closed by spots 34, 34 of welding which engage the lower end of the associated post section 30 to provide vertical support for it and the remainder of the post 14. The lowermost post section 30 also loosely passes through the table top 20, the table top having a central opening 36, shown best in FIG. 4, for this purpose.

Figure 5:
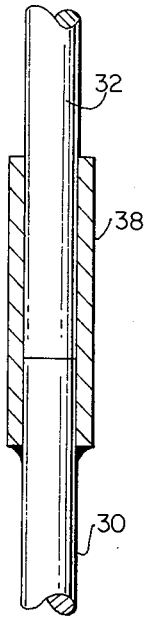
FIG. 5 is a view, partly in vertical section, and partly in elevation, taken on the line 5—5 of FIG. 2, showing one of the joints between two of the post sections of the plant stand of FIG. 1.

The adjacent ends of adjacent post sections are joined to one another by a joint means providing a slip fit telescopic connection. As shown best in FIG. 5, each of these joints includes a socket part 38 in the form of a length of tube which receives each of the adjacent end portions of the adjacent post sections. The tube is permanently fixed by welding to the lower one of the two joined post sections and loosely receives the lower end of the upper one of the two joined post sections. That is, the tubular socket part 38 is fixed to the upper end of each post section and forms an upwardly facing socket for slidably receiving the lower end of the next upwardly adjacent post section.

Figure 2:
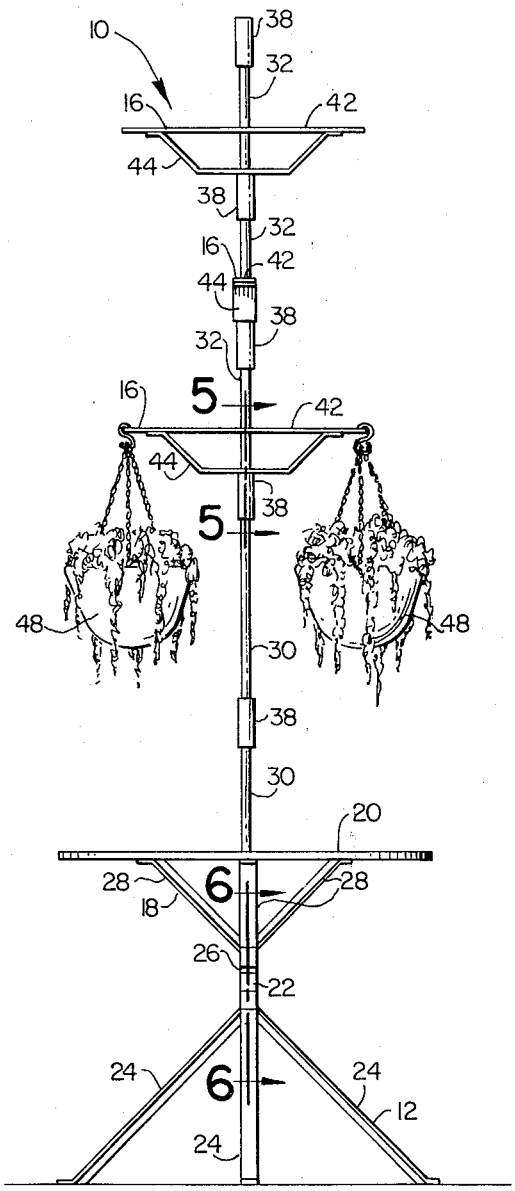
FIG 2. is a side elevational view of the plant stand of FIG. 1.
Figure 3:
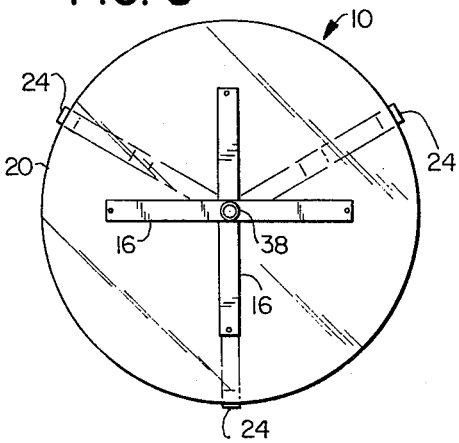
FIG. 3 is a top view of the plant stand of FIG. 1.
Figure 4:
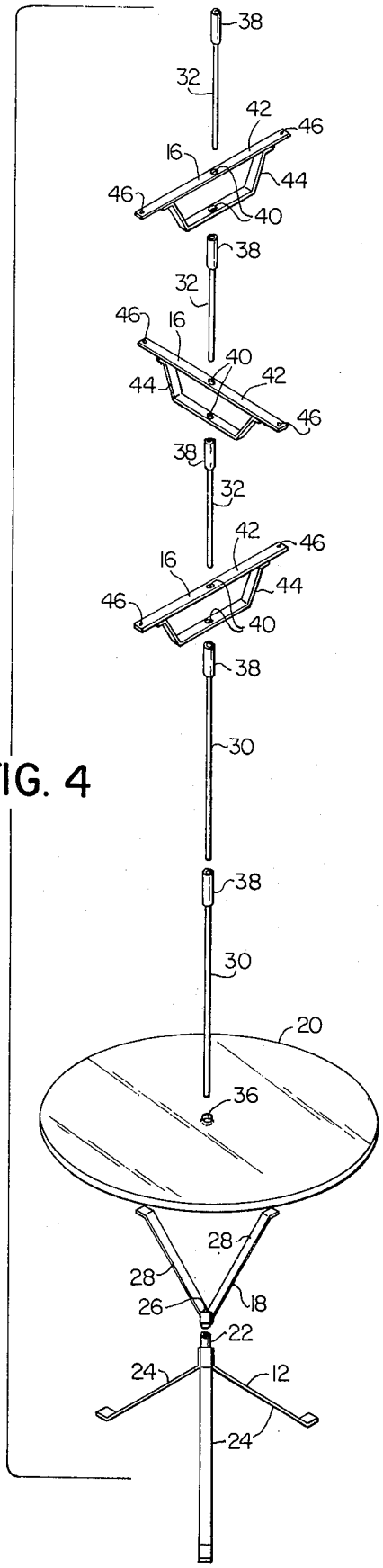
FIG. 4 is an exploded perspective view of the plant stand of FIG. 1.

The three brackets 16, 16 are loosely received on respective ones of the three short post sections 32, 32 with each bracket having holes 40, 40, shown in FIG. 4, through which its post section loosely passes. For vertical support, each bracket rests on the upper end of the socket part 38 of the joint directly beneath it, as shown in FIG. 2. The three brackets are of identical construction with each having two arms extending outwardly from the post 14 on diametrically opposite sides thereof and with each being made of two pieces 42 and 44. The piece 42 is straight. The piece 44 is U-shaped and has its outer ends riveted or welded to the piece 42. Therefore, at the center of each bracket, where the post passes through it, the two pieces 42 and 44 are spaced from one another by a substantial vertical distance providing a good moment arm for resisting tipping of the bracket about a horizontal axis relative to the post. On each side of the post 14 the upper piece 42 extends outwardly beyond the piece 44 and is provided with a hole 46 for use in attaching a suspended potted plant 48 or other article to the bracket.

From the foregoing it will be understood that the post 14 of the display stand is made of a number of individual post sections which may be readily disassembled from one another by slipping each post out of an associated socket part 38. As each of the short posts 32, 32 is removed from the stand its associated bracket 16 is also readily slipped therefrom for disassembly. Likewise, when the lowermost long post 30 is slipped upwardly out of the table support central part 26 and the base central part 22, the base 12, the table support 18 and the table top 20 all become disconnected from one another. The plant stand can thus be easily and readily disassembled into a number of small parts which can be arranged in a small container for packing and/or shipping, and the stand can subsequently be reassembled in short time with little effort.

Further, it will be understood that because of the loose fit between the table support central part 26 and the lowermost post section 30 the table support 18 and table top 20 are revolvable relative to the base 12 and the post 14. Similarly, because of the loose fit between each bracket 16 and its associated short post section 32 each bracket is revolvable relative to the post and may be pushed to any desired angular position to vary the display made by the stand. Also, the height of the stand may be varied by adding or subtracting post sections and brackets.

I claim:

1. A display stand comprising: a base, a post extending vertically upwardly from said base, said post consisting of a plurality of individual sections arranged end-to-end, joint means defining a slip fit telescopic joint at each pair of adjacent end portions of said post sections for releasably joining said post sections to one another, each of said joint means including a socket part fixed to one of its associated post sections and having a socket opening slidably receiving the other of its associated post sections, a plurality of brackets spaced along the length of said post, each of said brackets having said post passing loosely through it so as to be rotatable and slidable axially of said post, a plurality of means spaced from one another along the length of said post and each providing an upwardly facing support surface fixed relative to said post, each of said brackets further being engaged with and vertically supported by an associated one of said support surfaces, each of said brackets having at least one arm extending horizontally from said post and adapted at its outer end to support an article for display purposes, said base including means defining a socket opening loosely slidably receiving the lower end of the lowermost one of said post sections to provide a slip fit telescopic joint releasably joining said lowermost post section to said base, a table support, said table support consisting of a tubular central part through which said lowermost one of said post sections loosely passes and which part rests on said base for vertical support while being free to rotate relative to said base and said post, and a plurality of arms extending vertically upwardly and outwardly from said central part, and a horizontal table supported by the upper ends of said arms, said table having a central opening through which said post loosely passes.

2. A display stand as defined in claim 1 further characterized by said base comprising a tubular central part which loosely slidably receives the lower end of the lowermost one of said post sections, and a plurality of legs fixed to said tubular center part of said base and extending downwardly and outwardly therefrom, said tubular central part of said table support having a downwardly facing annular end surface and said tubular central part of said base having a conforming upwardly facing annular end surface which engages said downwardly facing annular end surface of said table support central part to vertically support said table support while nevertheless allowing said table support to rotate about the axis of said post relative to said base.

3. A display stand as defined in claim 2 further characterized by each of said post sections comprising a cylindrical rod, and said socket part of each of said joint means being a length of tube, said length of tube of each joint means having a bore receiving the end portions of both of the post sections joined thereby and being welded to one of said post sections, said length of tube of each of said joint means also having an exterior diameter substantially greater than that of said post sections and having at its upper end an upwardly facing annular end surface, said upwardly facing annular end surfaces of said lengths of tube being said upwardly facing support surfaces for said brackets.

* * * * *